US005123575A

United States Patent [19]

Li

[11] Patent Number: 5,123,575

[45] Date of Patent: Jun. 23, 1992

[54] MULTI-CHAMBER CONTAINER HAVING TWO INTERIOR PARTITIONS

[76] Inventor: Hofman Y. Li, 6031 N. Damen Ave., Chicago, Ill. 60659

[21] Appl. No.: 743,578

[22] Filed: Aug. 9, 1991

[51] Int. Cl.[5] ..... B67D 3/00

[52] U.S. Cl. ..... 222/564; 215/1 C; 222/547

[58] Field of Search ..... 222/564, 547, 454–456; 215/1 C

[56] References Cited

U.S. PATENT DOCUMENTS

| | | | |
|---|---|---|---|
| 2,370,820 | 3/1945 | Stott | 222/456 |
| 4,640,895 | 2/1987 | Davis | 435/296 |
| 4,646,948 | 3/1987 | Jennings | 222/454 |
| 4,832,211 | 5/1989 | Matthews et al. | 215/1 C |
| 4,856,685 | 8/1989 | Gaffney | 222/454 |
| 4,858,758 | 8/1989 | Mitchell et al. | 206/201 |
| 4,877,142 | 10/1989 | Doering | 215/1 C |
| 5,048,723 | 9/1991 | Seymour | 222/564 X |

FOREIGN PATENT DOCUMENTS

| | | | |
|---|---|---|---|
| 162516 | 2/1904 | Fed. Rep. of Germany | 222/564 |
| 2340909 | 3/1977 | Fed. Rep. of Germany . | |
| 407854 | 3/1934 | United Kingdom . | |

*Primary Examiner*—Kevin P. Shaver

*Attorney, Agent, or Firm*—Dressler, Goldsmith, Shore, Sutker & Milnamow, Ltd.

[57] ABSTRACT

A container for storing and pouring a liquid, such as motor oil, has top, bottom, and lateral walls, a spout extending upwardly from the top wall, and two interior partitions, which are horizontal in an upright position of the container. Each partition defines an orifice extending between such partition and a side wall. The partitions divide the container into primary, secondary, and tertiary chambers. The primary chamber, which is the lowest chamber when the container is upright, has a volume sufficient to contain a predetermined quantity of motor oil. The secondary and tertiary chambers have substantially smaller volumes. The partitions prevent the primary chamber from being emptied of a liquid, when the container is rotated in a prescribed direction, unless the container is inverted sufficiently to incline, at an angle of approximately 8° from horizontal, a planar surface being defined by each partition and facing the other partition.

10 Claims, 5 Drawing Sheets

MULTI-CHAMBER CONTAINER HAVING TWO INTERIOR PARTITIONS

TECHNICAL FIELD OF THE INVENTION

This invention pertains to an improved container for a liquid, such as motor oil. The container has two internal partitions, which prevent an interior chamber of the container from being emptied of a liquid unless the container is inverted sufficiently.

BACKGROUND OF THE INVENTION

Conventionally, motor oil, brake fluid, and other liquids used as additives for motor vehicle engines are distributed in molded containers having tubular necks, which define spouts. Doering U.S. Pat. No. 4,877,142 exemplifies such a container.

Commonly, so as to minimize spillage, a funnel is used when such a liquid is poured from such a container into an inlet of such an engine. Sometimes, however, a funnel is not available when it is desirable to add such a liquid to a motor vehicle engine. Occasionally, a funnel cannot be easily fitted into a tight space near the inlet, into which a user intends to pour such a liquid from such a container.

It is suggested in Gaffney U.S. Pat. No. 4,856,685 to provide such a container with a baffle, which prevents spillage until the container has been tipped past a horizontal position. When the container is rotated in one rotational direction (see FIGS. 7 through 10 of the Gaffney patent) it appears necessary to rotate the container about 12° to 13° past a horizontal position for a liquid to begin to pour from the container. When the container is tipped oppositely (see FIGS. 11, 12, and 13 of the Gaffney patent) it appears necessary to rotate the container about 32° past a horizontal position for a liquid to begin to pour from the container.

It would be highly desirable to provide for storing and pouring a liquid, such as motor oil or brake fluid, an improved container, from which the liquid would not pour unless the container had been rotated from an upright position, in a prescribed direction, so as to invert the container at least approximately 80° past a horizontal position.

SUMMARY OF THE INVENTION

This invention provides a improved container for storing and pouring a liquid, such as motor oil, brake fluid, or the like. The container has top, bottom, and lateral walls when disposed in a normal, upright position. The container has a spout adjoining and extending outwardly from the top wall and is closed except for the spout. The container has two interior partitions extending in generally parallel relation to each other and to the bottom wall. The partitions prevent the container from being emptied when the container is rotated from the upright position, in a prescribed direction, unless the container is inverted sufficiently.

Thus, a first partition extends across the container except for a first orifice, which is defined by the first partition. Also, a second partition extends across the container except for a second orifice, which is defined by the first partition. The partitions divide the container into three interior chambers, namely a primary chamber between the first partition and the bottom wall, a secondary chamber between the partitions, and a tertiary chamber between the top wall and the second partition. The primary chamber has a volume which is substantially greater than the combined volumes of the secondary and tertiary chambers.

When the container is rotated from the upright position in the prescribed direction, the container is rotated in a rotational direction tending to raise the second orifice relative to the first orifice and to lower the first orifice relative to the second orifice upon initial rotation of the container from the upright position. The partitions prevent the primary chamber from being emptied of a liquid when the container is rotated from the upright position in the prescribed direction, unless the container is inverted sufficiently upon further rotation of the container in the same direction to dispose the first orifice at the lowest part of the primary chamber and to dispose at least part of the second orifice below at least part of the first orifice. When the container is inverted sufficiently, a liquid can pour from the primary chamber into the secondary chamber, from the secondary chamber into the tertiary chamber, and from the tertiary chamber into the spout, and air can pass oppositely into the container.

In one contemplated arrangement, in which each partition defines two planar surfaces, the partitions prevent the primary chamber from being emptied of a liquid unless the container is inverted sufficiently to incline the planar surfaces defined by the partitions at an angle less than approximately 10° from horizontal. It is preferred that the angle is approximately 8° from horizontal.

Preferably, the container has four side walls, namely two relatively narrow walls and two relatively wide walls. Preferably, moreover, each orifice extends between a respective one of the partitions and a respective one of the relatively narrow walls. Thus, the orifice defined by the first partition extends between the first partition and a first one of the relatively narrow walls. Also, the orifice defined by the second partition extends between the second partition and a second one of the relatively narrow walls. It is preferred that the spout is disposed so as to be substantially tangent, at an inner surface of the spout, to a plane defined by an inner surface of the second one of the relatively narrow walls.

In a preferred construction, in which the spout has a terminal portion and a tubular portion between the terminal portion and the top wall, the tubular portion has a relatively large, inside diameter where the tubular portion adjoins the top wall. Such diameter is more than twice the maximum distance across each orifice. The maximum distance is measured between the partition defining such orifice and the nearer one of the relatively narrow walls. The terminal portion may be externally threaded.

In a preferred embodiment, the relatively narrow walls are spaced from each other by a distance in a range from approximately 4.375 inches to approximately 4.75 inches, the maximum distance across each orifice is approximately 0.325 inch, and the partitions are spaced from each other by approximately 0.625 inch.

Moreover, in the preferred embodiment, the top wall is spaced from the second partition by at least approximately 0.5 inch. In an alternative embodiment, the top wall is sloped at an acute angle relative to the partitions, so as to incline toward the spout in the upright position of the container. It is preferred that the acute angle is approximately 20°.

These and other objects, features, and advantages of this invention are evident from the following description of a preferred embodiment of this invention, an alternative embodiment thereof, and a modified embodiment thereof, with reference to the accompanying drawings.

DETAILED DESCRIPTION OF ILLUSTRATED EMBODIMENTS

Figure 1:
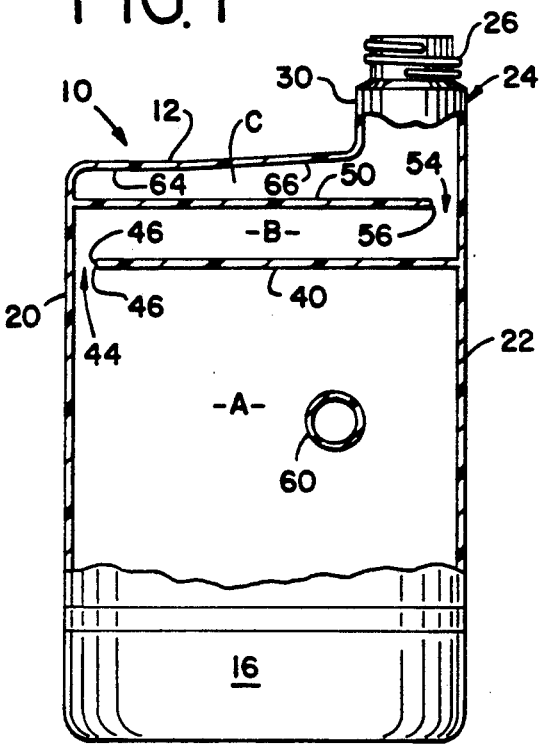
FIG. 1, which is drawn partly in side elevation and partly in vertical cross-section, shows a container constituting a preferred embodiment of this invention. The container, which is adapted to contain a predetermined quantity of motor oil, is shown in an upright position.
Figure 2:
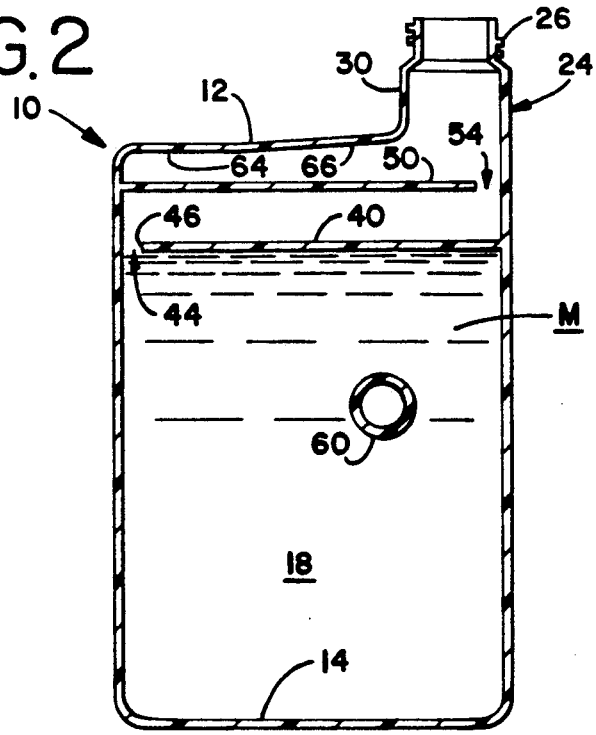
FIG. 2, which is drawn in vertical cross-section, shows the container of FIG. 1, as used to contain a predetermined quantity of motor oil.

As shown in FIGS. 1 and 2 and other views, a container 10 for motor oil M constitutes a preferred embodiment of this invention. The container 10 is sized to contain motor oil M in a predetermined quantity, such as one U.S. quart or one liter, preferably one U.S. quart. The container 10 may be alternatively used to contain another liquid, such as brake fluid or transmission fluid, or to contain a liquid other than an additive for a motor vehicle engine. As described below, the container 10 has two internal partitions, which prevent the container 10 from being emptied of motor oil M, when the container is rotated in a prescribed direction explained below, unless the container 10 is inverted sufficiently.

The container 10 may be injection-molded in two halves (to be suitably bonded to each other) from a polymeric material, such as high density polyethylene, which is suitable for direct contact with motor oil. Herein, directional terms, such as "top", "bottom", and "lateral", refer to the container 10 in a normal, upright position, in which it is shown in FIG. 1.

The container 10 is similar to known containers with similar uses in having a top wall 12, a bottom wall 14, and four lateral walls, namely two relatively wide walls 16, 18, and two relatively narrow walls 20, 22. The container 10 has a spout 24 extending upwardly from the top wall 12. The spout 24 has a terminal portion 26, which is threaded externally so as to accommodate an internally threaded cap (not shown) of a conventional construction, and a tubular portion 30 between the terminal portion 26 and the top wall 12. The spout 24 is disposed so as to be substantially tangent, at an inner surface of the spout 24, to a plane defined by an inner surface of the relatively narrow wall 22. The container 10 is closed except for the spout 24, which is open unless such a cap is threaded onto the terminal portion 26 of the spout 24.

The container 10 differs from known containers with similar uses in having two internal partitions parallel to the bottom wall 14. Thus, a first partition 40 extends across the container 10, between the relatively wide walls 16, 18, and from the relatively narrow wall 22 toward the relatively narrow wall 20, except for a first orifice 44, which is defined by the first partition 40. The first orifice 44 extends between one edge 46 of the first partition 40 and the relatively narrow wall 20. Also, a second partition 50 extends across the container 10, between the relatively wide walls 16, 18, and from the relatively narrow wall 20 toward the relatively narrow wall 22, except for a second orifice 54 defined by the second partition 50. The second orifice 54 extends between one edge 56 of the second partition 50 and the relatively narrow wall 22. When the container is in the normal, upright position, the first partition 40 is below the second partition 50. When the container 10 is in the normal, upright position, the partitions 40, 50, extend in generally horizontal directions. Each partition defines two planar surfaces, namely a planar surface facing the other partition and a planar surface facing oppositely.

The partitions 40, 50, divide the container 10 into three interior chambers, namely a primary chamber A between the first partition 40 and the bottom wall 14, a secondary partition B between the partitions 40, 50, and a tertiary chamber C between the top wall 12 and the second partition 50. The primary chamber A communicates with the secondary chamber B via the first orifice 44 defined by the first partition 40. The secondary chamber B communicates with the tertiary chamber C via the second orifice 54 defined by the second partition 50. The primary chamber A has a volume sufficient for the primary chamber A to contain the predetermined quantity (e.g. one U.S. quart) of motor oil M. The volume of the primary chamber A is substantially larger than the combined volumes of the secondary and tertiary chambers.

When the container 10 is rotated in the prescribed direction, the container 10 is rotated from the upright position in a rotational direction (counterclockwise in the drawings) tending to raise the second orifice 54 relative to the first orifice 44 and to lower the first orifice 44 relative to the second orifice 54 upon initial rotation of the container 10 from the upright position. Rotation of the container 10 in the prescribed direction is suggested by a progression from FIG. 2 to FIG. 3, from FIG. 3 to FIG. 4, and from FIG. 4 to FIG. 5. When the container 10 is rotated from the upright position in the prescribed direction, once the container 10 has been inverted sufficiently to dispose the first orifice 44 at the lowest part of the primary chamber A and to dispose at least part of the second orifice 54 below at least part of the first orifice 44, motor oil M pours from the primary chamber A into the secondary chamber B, from the secondary chamber B into the tertiary chamber C, and from the tertiary chamber C into the spout 24. Simultaneously, air passes from the spout 24 into the tertiary chamber C, from the tertiary chamber C into the secondary chamber B, and from the secondary chamber B into the primary chamber A. Because the container 10 is closed except for the spout 24, motor oil M tends to pour pulsatingly from the container 10, and air tends to bubble upwardly into the container 10.

Preferably, where the tubular portion 30 of the spout 24 adjoins the top wall 12, the tubular portion 30 has a relatively large diameter, which is more than twice the maximum distance across each of the orifices 44, 54. The maximum distance across each orifice is measured between the partition defining such orifice and the nearer one of the relatively narrow walls 20, 22, along an imaginary line lying in an imaginary plane disposed halfway between the relatively wide walls 16, 18. Thus, the maximum distance across the first orifice 44 is measured between the edge 46 of the partition 40 and the wall 22, along such an imaginary line. Also, the maximum distance across the second orifice 54 is measured between the edge 56 of the partition 50 and the wall 20, along such an imaginary line.

The container 10 has some preferred dimensions. It is preferred that the relatively narrow walls are spaced from each other by a distance in a range from approximately 4.375 inches to approximately 4.75 inches, that the maximum distance across each orifice is approximately 0.325 inch, and that the partitions 40, 50, are spaced from each other by approximately 0.625 inch. Such preferred dimensions entail that the partitions 40, 50, prevent the primary chamber A from being emptied of motor oil M unless the container 10 is inverted sufficiently to incline the planar surfaces defined by the partitions 40, 50, at an angle less than approximately 10° from horizontal. Optimally, the container 10 is dimensioned such that the partitions 40, 50, prevent the primary chamber A from being emptied of motor oil M unless the container 10 is rotated so as to incline the planar surfaces defined by the partitions 40, 50, at an angle of approximately 8° from horizontal.

Preferably, the top wall 12 is spaced from the second partition 50 by approximately 0.5 inch. Other dimensions of the container 10 may be arbitrarily selected and depend upon its shape and upon its intended capacity.

Because the polymeric material of the container 10 tends to be somewhat flexible, it is preferred to mold the container 10 with an integral, tubular strut 60 extending through the container, between the relatively wide walls 16, 18. The strut 60 limits flexure of the relatively wide walls 16, 18, toward each other, when the container 10 is gripped by a user, so as to minimize tendencies for motor oil M to be accidentally squirted from the container 10 by the user.

As shown, a portion 64 of the top wall 12 near the relatively narrow wall 12 is parallel to the partitions 40, 50, and a portion 66 of the top wall 12 between the portion 64 and the spout 24 is sloped at a slight angle (e.g. 1° to 2°) relative to the portion 64. The container 10 has rounded edges where the respective walls adjoin one another and where the spout 24 adjoins the top wall 12.

As shown in FIG. 2, it is preferred to fill the container 10 with motor oil M to a level at a slight distance (e.g. approximately 0.0625 inch) below the first partition 40, in the upright position of the container 10. Thus, if the container 10 is rotated from the upright position in a rotational direction (clockwise in the drawings) opposite to the prescribed direction or if the container 10 is rotated from the upright position in a different rotational direction, there is little if any tendency for even a small quantity of motor oil M to spill from the container 10 until the container 10 has been rotated more than approximately one quarter-turn from the upright position.

Figure 3:
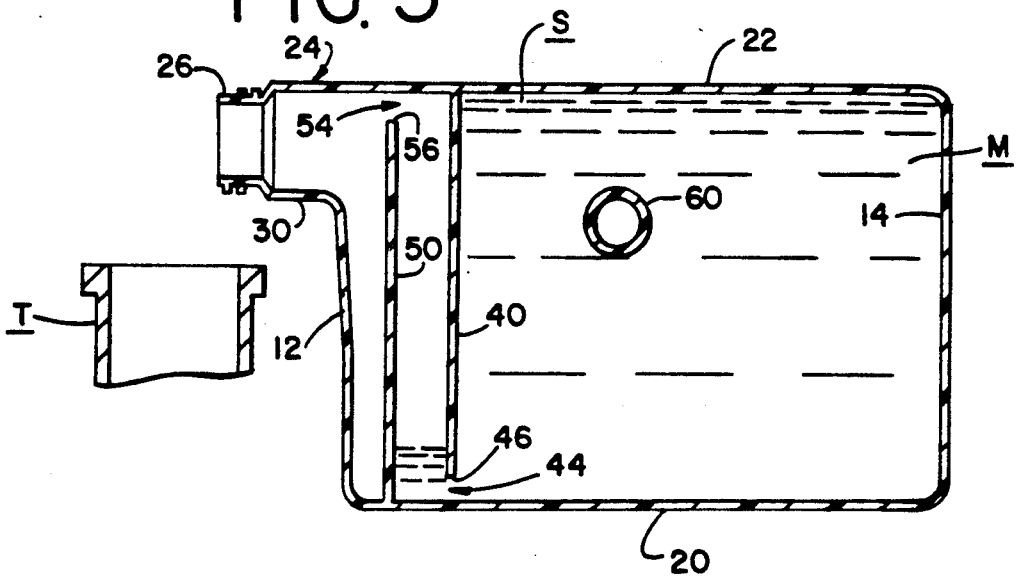
FIG. 3 is a view similar to FIG. 2 except that the container has been rotated by one quarter-turn from its upright position. Motor oil has not begun to pour from the container.
Figure 4:
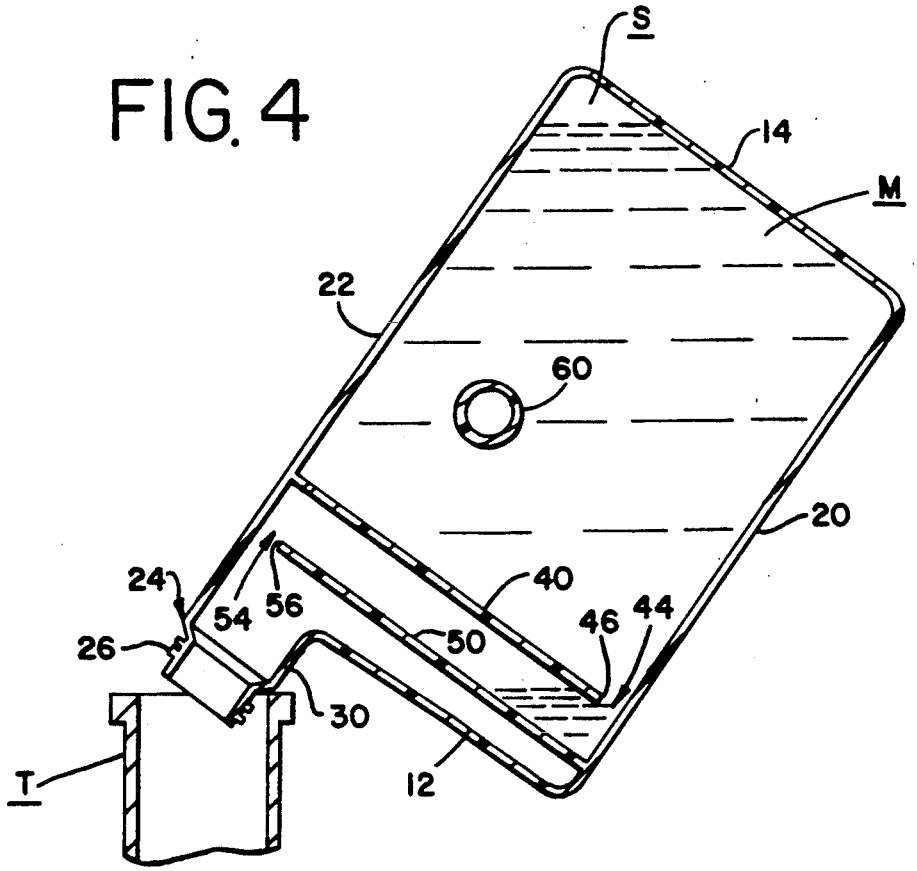
FIG. 4 is a view similar to FIGS. 2 and 3 except that the container has been rotated further Motor oil has not begun to pour from the container.

As shown in FIG. 3, in which the container 10 is shown having been brought near a filling tube T of a motor vehicle engine, motor oil M does not pour from the container 10 when the container 10 is rotated in the prescribed direction by approximately one quarter-turn from the upright position. As shown in FIG. 4, in which the spout 24 is shown to have been inserted partly into the filling tube T, motor oil M does not pour or spill from the container 10 when the container 10 is rotated further by approximately one-eighth turn. In each case, although a small quantity of air may become trapped in a head space S above a large quantity of motor oil M in the primary chamber A and a small quantity of motor oil M may enter the secondary chamber B, air at ambient pressure prevents motor oil M from overflowing the edge 56 of the second partition 50.

Figure 5:
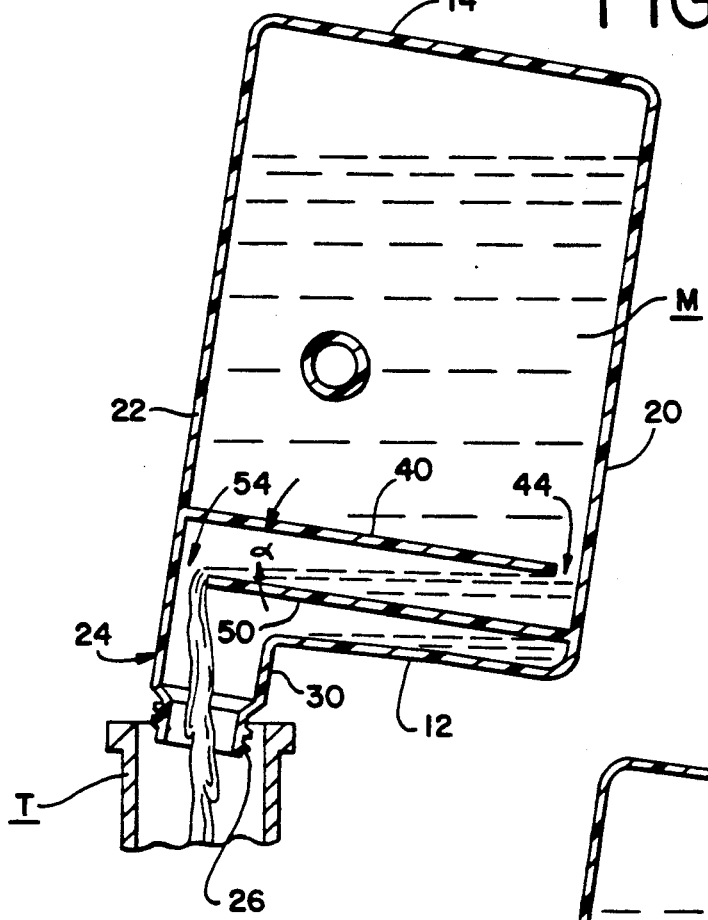
FIG. 5 is a view similar to FIGS. 2, 3, and 4 except that the container has been rotated further, so as to be substantially inverted in a manner contemplated by this invention. Motor oil has begun to pour from the container.

As shown in FIG. 5, in which the spout 24 is shown to have been inserted further into the filling tube T, motor oil M can pour from the primary chamber A into the secondary chamber B, from the secondary chamber B into the tertiary chamber C, and from the tertiary chamber C into the spout, so as to empty the primary chamber A of motor oil M, when the container is rotated additionally until the planar surfaces of the partitions 40, 50, define an angle $\alpha$ of less than approximately 10° from horizontal, preferably an angle $\alpha$ of approximately 8° from horizontal. As shown in FIG. 5, a small quantity of motor oil M accumulates in the secondary chamber B and a small quantity of motor oil M may accumulate in the tertiary chamber, unless the container 10 is rotated further to or beyond a fully inverted position.

Figure 1A:
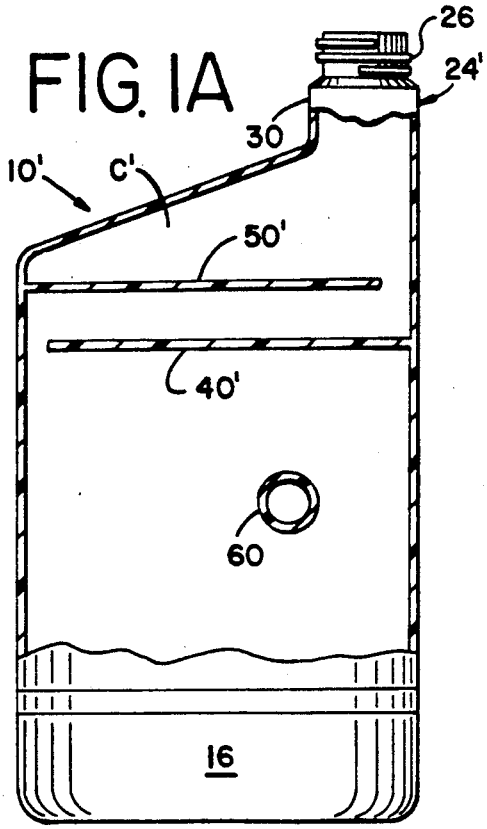
FIG. 1A, which is drawn partly in side elevation and partly in vertical cross-section, shows a container constituting an alternative embodiment of this invention. The container, which is adapted to contain a predetermined quantity of motor oil, is shown in an upright position.
Figure 5A:
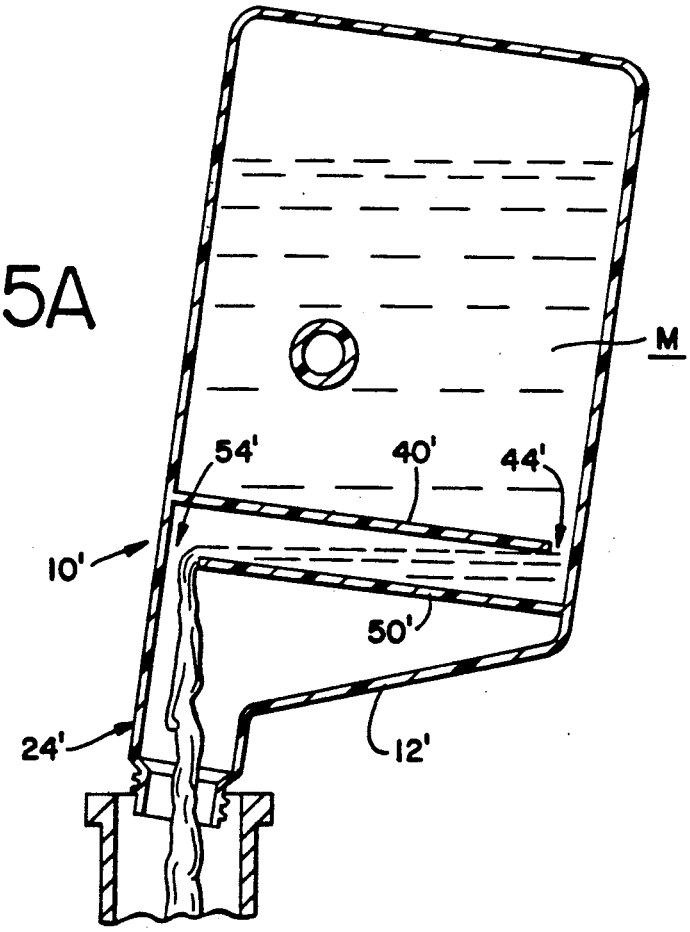
FIG. 5A is a view similar to FIG. 5 but taken to show the container of FIG. 1A. The container has been rotated so as to be similarly inverted. Motor oil has begun to pour from the container.

A possible modification is shown in FIGS. 1A and 5A, in which primed references designate elements similar to elements designated by unprimed references in FIG. 1 and other views, except as described below. As shown in FIGS. 1A and 5A, a container 10' for motor oil M constitutes an alternative embodiment of this invention.

The container 10' is similar to the container 10 except that the top wall 12' is sloped at an angle of approximately 20° relative to the partitions 40', 50', so as to incline upwardly toward the spout 24' in the upright position of the container 10'. As compared to the volume of the tertiary chamber C of the container 10, the volume of the tertiary chamber C' of the container 10' is larger, which facilitates filing of the container 10' with motor oil M, through the spout 24'. The partition 40' defines an orifice 44' similar to the orifice 40 defined by the partition 40. The partition 50' defines an orifice 54' similar to the orifice 54 defined by the partition 50.

FIGS. 6 through 9 illustrate a modified container 10'', which is similar to the container 10 except that the spout 24 is not disposed so as to be substantially tangent, at an inner surface of the spout 24, to a plane defined by an inner surface of the relatively narrow wall 22. Rather, in the container 10'', the spout 24 adjoins the top wall 12 at a location that is substantially closer to the relatively narrow wall 24 than to the relatively narrow wall 20. Preferably, in the container 10'', the spout 24 is spaced from the relatively narrow wall 20 by a distance x equal approximately to 0.75 inch, the distance x being indicated in FIG. 6.

Figure 6:
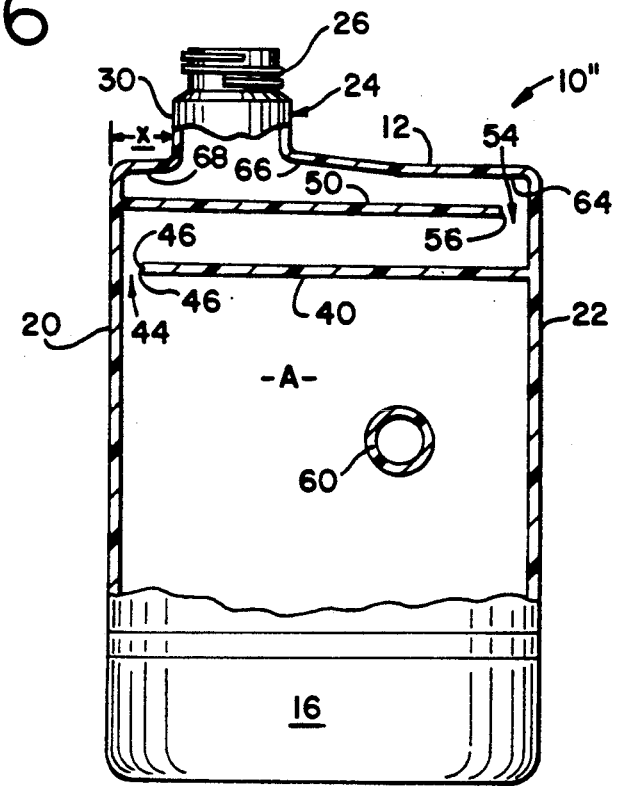
FIGS. 6, 7, 8, and 9 are similar to FIGS. 1, 3, 4, and 5 respectively but show a modified embodiment, in which the container has a differently located spout.
Figure 7:
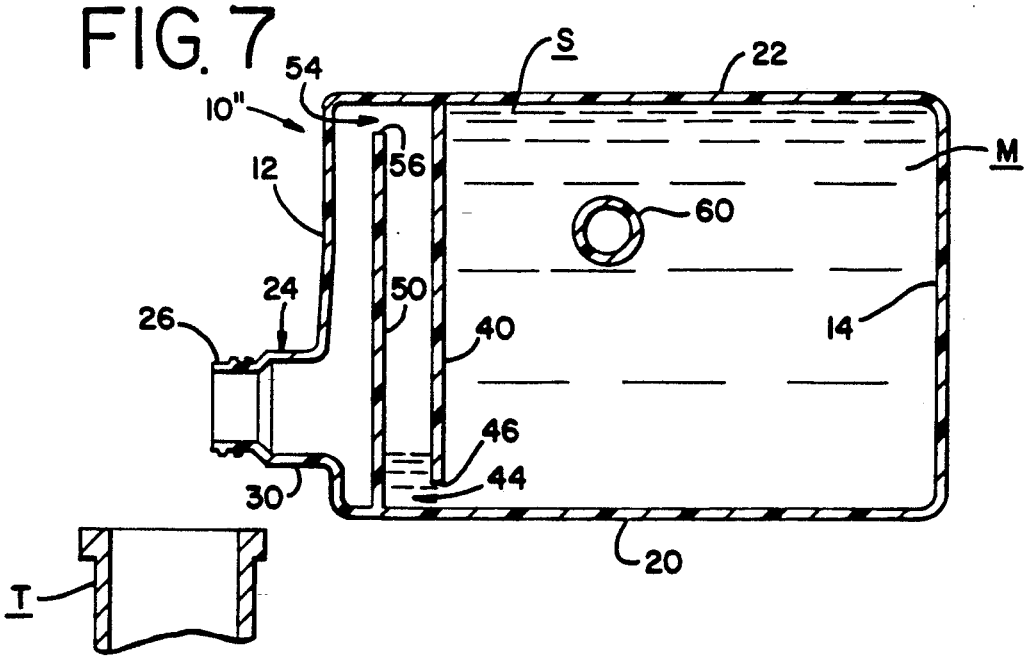
Figure 8:
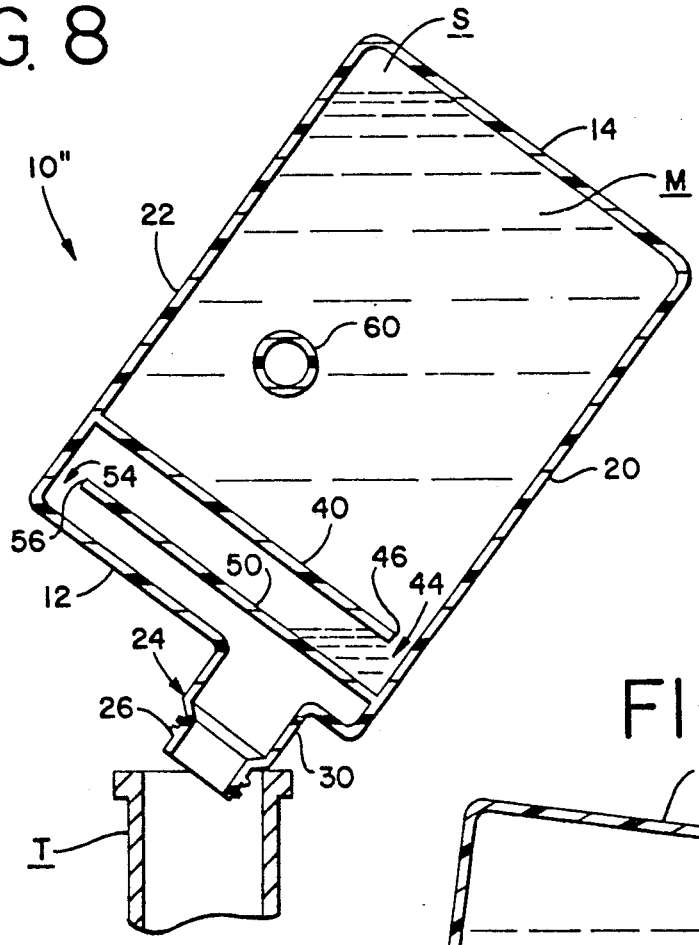
Figure 9:
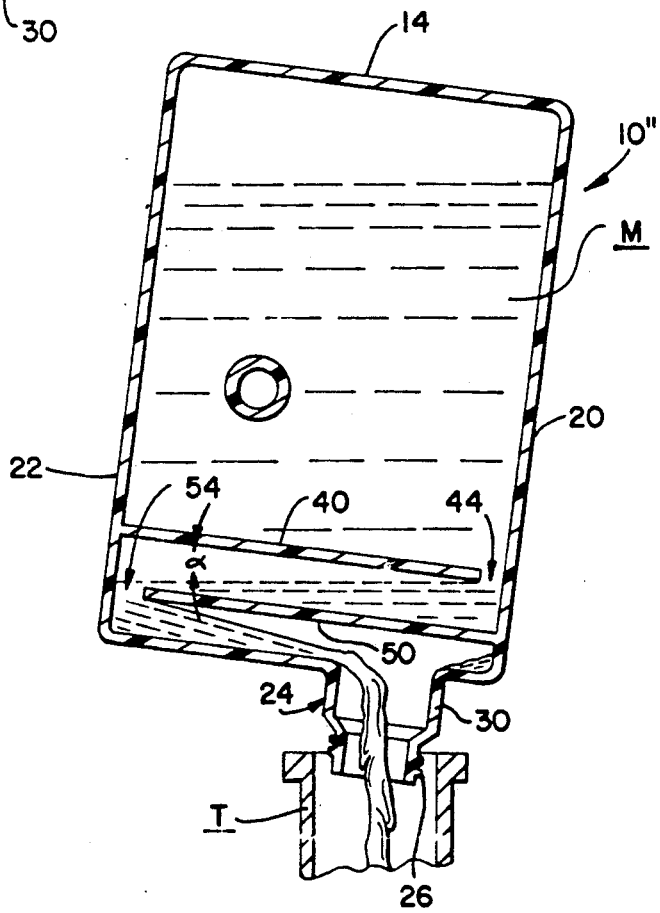

Rotation of the container 10" in the prescribe direction (counterclockwise in the drawings) is suggested by a progression from FIG. 6 to FIG. 7, from FIG. 7 to FIG. 8 and from FIG. 8 to FIG. 9. When the container 10" is rotated from the upright position in the prescribed direction, the partitions 40, 50, prevent the primary chamber A from being emptied of motor oil M unless the container 10" is inverted sufficiently to incline the planar surfaces defined by the partitions 40, 50, at an angle less than approximately 10° from horizontal. Optimally, the container 10 is dimensioned such that the partitions 40, 50, prevent the primary chamber A from being emptied of motor oil M unless the container 10" is rotated so as to incline the planar surfaces defined by the partitions 40, 50, at an angle of approximately 8° from horizontal.

Various other modifications may be made in the several embodiments described above without departing from the scope and spirit of this invention.

I claim:

1. A container for storing and pouring a liquid, such as motor oil, the container having top, bottom, and lateral walls when disposed in an upright position for storing the liquid and a spout adjoining and extending upwardly from the top wall in the upright position of the container, the container being closed except for the spout;

the container having two interior partitions extending in generally horizontal directions in an upright position of the container, namely a first partition extending across the container except for an orifice defined by the first partition and a second partition extending across the container except for an orifice defined by the second partition, the partitions dividing the container into three interior chambers, namely a primary chamber between the first partition and the bottom wall, a secondary chamber between the first and second partitions, and a tertiary chamber between the top wall and the second partition, the primary chamber having a volume which is substantially larger than the combined volumes of the secondary and tertiary chambers;

the partitions constituting means for preventing the primary chamber from being emptied of a liquid when the container is rotated from the upright position in a rotational direction tending to raise the second orifice relative to the first orifice and to lower the first orifice relative to the second orifice upon initial rotation of the container, unless the container is inverted sufficiently upon further rotation of the container in the same direction to dispose the first orifice at the lowest part of the primary chamber and to dispose at least part of the second orifice below at least part of the first orifice;

the container having four lateral walls, namely two relatively narrow walls and two relatively wide walls, each orifice extending between a respective one of the partitions and a respective one of the relatively narrow walls, wherein the orifice defined by the first partition extends between the first partition and a first one of the relatively narrow walls, wherein the orifice defined by the second partition extends between the second partition and a second one of the relatively narrow walls, and wherein the spout is disposed so as to be substantially tangent, at an inner surface of the spout, to a plane defined by an inner surface of the second one of the relatively narrow walls.

2. The container of claim 1 wherein the spout has a terminal portion and a tubular portion between the terminal portion and the top wall, the tubular portion having a relatively large, inside diameter where the tubular portion adjoins the top wall, said diameter being more than twice the maximum distance across each orifice, the maximum distance being measured between the partition defining such orifice and the nearer one of the relatively narrow walls.

3. The container of claim 2 wherein the terminal portion is threaded externally.

4. The container of claim 2 wherein the relatively narrow walls are spaced from each other by a distance in a range from approximately 4.375 inches to approximately 4.75 inches, wherein said diameter where the tubular portion of the spout adjoins the top wall measures approximately 1.25 inches, wherein the maximum distance across each orifice is approximately 0.325 inch, and wherein said partitions are spaced from each other by approximately 0.625 inch.

5. The container of claim 4 wherein the top wall is spaced from the second partition by approximately 0.5 inch along substantially all of the top wall.

6. The container of claim 5 wherein at least a portion of the top wall is generally parallel to the partitions.

7. The container of claim 5 wherein the top wall is sloped at an angle of approximately 20° relative to the partitions, so as to incline upwardly toward the spout in the upright position of the container.

8. The container of claim 1 wherein each partition defines two planar surfaces, the partitions constituting means for preventing the primary chamber from being emptied of a liquid, when the container is rotated as set forth, unless the container is inverted sufficiently to incline the planar surface defined by each partition at an angle less than approximately 10° from horizontal.

9. The container of claim 1 wherein the partitions constitute means for preventing the primary chamber from being emptied of a liquid, when the container is rotated as set forth, unless the container is inverted sufficiently to incline the planar surface defined by each partition at an angle of approximately 8° from horizontal.

10. A container for storing and pouring a liquid, such as motor oil, the container having top, bottom, and lateral walls when disposed in an upright position for storing the liquid and a spout adjoining and extending upwardly from the top wall in the upright position of the container, the container being closed except for the spout;

the container having two interior partitions extending in generally horizontal directions in an upright position of the container, namely a first partition extending across the container except for an orifice defined by the first partition and an second partition extending across the container except for an orifice defined by the second partition, the partitions dividing the container into three interior chambers, namely a primary chamber between the first partition and the bottom wall, a secondary chamber between the first and second partitions, and a tertiary chamber between the top wall and the second partition, the primary chamber having a volume which is substantially larger than the combined volumes of the secondary and tertiary chambers;

the partitions constituting means for preventing the primary chamber from being emptied of a liquid when the container is rotated from the upright position in a rotational direction tending to raise the second orifice relative to the first orifice and to lower the first orifice relative to the second orifice upon initial rotation of the container, unless the container is inverted sufficiently upon further rotation of the container in the same direction to dispose the first orifice at the lowest part of the primary chamber and to dispose at least part of the second orifice below at least part of the first orifice;

the container having four lateral walls, namely two relatively narrow walls and two relatively wide walls, each orifice extending between a respective one of the partitions and a respective one of the relatively narrow walls, wherein the orifice defined by the first partition extends between the first partition and a first one of the relatively narrow walls, wherein the orifice defined by the second partition extends between the second partition and a second one of the relatively narrow walls, and wherein the spout is disposed so as to be substantially tangent, at an inner surface of the spout, to a plane defined by an inner surface of the second one of the relatively narrow walls.

* * * * *